US009844865B2

(12) United States Patent
Furuta et al.

(10) Patent No.: US 9,844,865 B2
(45) Date of Patent: Dec. 19, 2017

(54) DRIVER TOOL

(71) Applicant: MAKITA CORPORATION, Anjo-shi (JP)

(72) Inventors: Takefumi Furuta, Anjo (JP); Shinji Hirabayashi, Anjo (JP); Tadasuke Matsuno, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 519 days.

(21) Appl. No.: 14/391,263

(22) PCT Filed: Apr. 4, 2013

(86) PCT No.: PCT/JP2013/060375

§ 371 (c)(1),
(2) Date: Oct. 8, 2014

(87) PCT Pub. No.: WO2013/154032

PCT Pub. Date: Oct. 17, 2013

(65) Prior Publication Data

US 2015/0174748 A1 Jun. 25, 2015

(30) Foreign Application Priority Data

Apr. 9, 2012 (JP) ..... 2012-088842

(51) Int. Cl.
*B25C 5/02* (2006.01)
*B25C 5/06* (2006.01)
(Continued)

(52) U.S. Cl.
CPC ..... *B25C 1/047* (2013.01); *B25C 1/04* (2013.01); *B25C 1/06* (2013.01)

(58) Field of Classification Search
CPC ..... B25C 1/047; B25C 1/06; B25D 16/00; B25D 9/12; B25D 17/245; B25D 17/22; B25D 9/04; B25D 9/08; B25D 9/145
(Continued)

(56) References Cited

U.S. PATENT DOCUMENTS 1,071,387 A 8/1913 Behr
1,829,609 A 10/1931 Robinson
(Continued)

FOREIGN PATENT DOCUMENTS

JP S63229274 A 9/1988
JP H01115579 A 5/1989
(Continued)

OTHER PUBLICATIONS

International Search Report from PCT/JP2013/060375.
(Continued)

*Primary Examiner* — Robert Long
(74) *Attorney, Agent, or Firm* — J-Tek Law PLLC; Jeffrey D. Tekanic; Scott T. Wakeman

(57) ABSTRACT

A driving tool includes a first cylinder that generates compressed air by reciprocating movement of a first piston slidably disposed therein. A longitudinal direction of the first cylinder intersects a longitudinal direction of a second cylinder and extends alongside a magazine that feeds fasteners onto an axis of movement of a driving part of a second piston. The first piston reciprocally slides in a direction that extends alongside the magazine. A tool handle is disposed on the side of the first cylinder that is opposite from the magazine in the direction of the axis of movement.

18 Claims, 11 Drawing Sheets

(51) Int. Cl.
*B25C 1/04* (2006.01)
*B25C 1/06* (2006.01)

(58) Field of Classification Search
USPC ..... 227/130, 132, 134
See application file for complete search history.

(56) References Cited

U.S. PATENT DOCUMENTS

| | | | | |
|---|---|---|---|---|
| 3,552,274 | A * | 1/1971 | Bojan | B25C 1/041 91/399 |
| 3,602,103 | A | 8/1971 | Powers | |
| 3,638,534 | A * | 2/1972 | Ramspeck | B25C 1/041 91/399 |
| 3,821,992 | A | 7/1974 | Matsuo | |
| 3,824,898 | A * | 7/1974 | Pauliukonis | F15B 11/064 91/416 |
| 3,878,902 | A | 4/1975 | Matsuo | |
| 3,995,703 | A * | 12/1976 | Wanner | B06B 1/183 173/105 |
| 4,344,555 | A | 8/1982 | Wolfberg | |
| 5,996,874 | A | 12/1999 | Fukushima et al. | |
| 6,755,336 | B2 | 6/2004 | Harper et al. | |
| 7,419,079 | B2 | 9/2008 | Chen et al. | |
| 7,793,811 | B1 | 9/2010 | Pedicini et al. | |
| 8,079,504 | B1 | 12/2011 | Pedicini et al. | |
| 2007/0045377 | A1 | 3/2007 | Towfighi | |
| 2007/0138230 | A1* | 6/2007 | Gschwend | B25C 1/08 227/10 |
| 2008/0190988 | A1 | 8/2008 | Pedicini et al. | |
| 2008/0217372 | A1* | 9/2008 | Webb | B25C 1/08 227/10 |
| 2009/0090762 | A1 | 4/2009 | Leimbach et al. | |
| 2009/0184148 | A1 | 7/2009 | Dittrich et al. | |
| 2009/0321492 | A1 | 12/2009 | Shima et al. | |
| 2010/0213235 | A1 | 8/2010 | Pedicini et al. | |
| 2010/0236802 | A1* | 9/2010 | Berger | B25D 11/064 173/118 |
| 2010/0237126 | A1 | 9/2010 | Matsunaga et al. | |
| 2011/0108600 | A1 | 5/2011 | Pedicini et al. | |
| 2011/0155403 | A1* | 6/2011 | Rohrer | E04H 17/263 173/114 |
| 2011/0240709 | A1* | 10/2011 | Oouchi | B25C 1/08 227/8 |
| 2012/0187178 | A1* | 7/2012 | Campbell | B25C 1/047 227/130 |
| 2012/0286014 | A1 | 11/2012 | Pedicini et al. | |
| 2014/0054350 | A1 | 2/2014 | Pedicini | |
| 2014/0374461 | A1 | 12/2014 | Pedicini et al. | |
| 2015/0122868 | A1* | 5/2015 | Campbell | B25C 1/047 227/130 |
| 2015/0129630 | A1 | 5/2015 | Matsuno | |
| 2015/0158160 | A1 | 6/2015 | Kato | |
| 2015/0174748 | A1 | 6/2015 | Furuta et al. | |
| 2015/0217436 | A1 | 8/2015 | Yanagihara et al. | |
| 2015/0298308 | A1 | 10/2015 | Kato | |
| 2015/0314432 | A1 | 11/2015 | Yang et al. | |

FOREIGN PATENT DOCUMENTS

| | | | |
|---|---|---|---|
| JP | H0396751 | A | 4/1991 |
| JP | H666967 | U | 9/1994 |
| JP | 200417206 | A | 1/2004 |
| JP | 2004017206 | A | 1/2004 |
| JP | 200990384 | A | 4/2009 |
| JP | 2009172762 | A | 8/2009 |
| JP | 20105776 | A | 1/2010 |
| JP | 2010173044 | A | 8/2010 |
| JP | 2011025362 | A | 2/2011 |
| JP | 2011025363 | A | 2/2011 |
| JP | 2011056613 | A | 3/2011 |
| JP | 2012148346 | A | 8/2012 |
| JP | 2012518553 | A | 8/2012 |
| JP | 2013233608 | A | 11/2013 |
| WO | 2011010511 | A1 | 1/2011 |
| WO | 2013168718 | A1 | 11/2013 |
| WO | 2014069648 | A1 | 5/2014 |

OTHER PUBLICATIONS

Written Opinion from PCT/JP2013/060375.
Unpublished U.S. Appl. No. 14/399,647.
Unpublished U.S. Appl. No. 14/440,143.
Unpublished U.S. Appl. No. 14/565,993.
Unpublished U.S. Appl. No. 14/685,783.
Unpublished copending U.S. Appl. No. 14/391,283.
Office Action from the German Patent Office dated Jan. 26, 2016 in related German application No. 11 2013 001 960.4, and translation of substantive portions thereof.
Office Action from the Japanese Patent Office dated Jun. 2, 2015 in related Japanese application No. 2012-088842, and translation of substantive portions thereof.
Office Action from the Japanese Patent Office dated Jun. 2, 2015 in related Japanese application No. 2012-088843, and translation of substantive portions thereof.
Office Action from the United States Patent Office dated May 15, 2017 in related U.S. Appl. No. 14/391,283.

* cited by examiner

DRIVER TOOL

CROSS-REFERENCE

This application is the U.S. National Stage of International Application No. PCT/JP2013/060375 filed on Apr. 4, 2013, which claims priority to Japanese patent application no. 2012-088842 filed on Apr. 9, 2012.

TECHNICAL FIELD

The present invention relates to a driving tool that performs a driving operation of a struck material.

BACKGROUND ART

Japanese Laid-open Patent Publication No. 2011-25363 discloses an electric/pneumatic driving tool having a battery-powered electric motor and a compression device which is driven by the electric motor. In this driving tool, compressed air generated by the compression device is supplied into a cylinder, and a driving mechanism is linearly moved by this compressed air, so that a nail serving as a struck material is driven.

SUMMARY OF THE INVENTION

Incidentally, in case a nail driving operation will be performed, it is important to realize a size reduction of the driving tool from the viewpoint of improving operability. In the driving tool described in Japanese Laid-open Patent Publication No. 2011-25363, a compression cylinder for use in generating compressed air is disposed close and parallel to the driving cylinder, and a handle is connected to intersect with the compression cylinder.

In a structure in which the compression cylinder and the driving cylinder are disposed in parallel with each other, however, if a piston is designed to have a stroke required to generate compressed air, a rear region (compression chamber) of the compression cylinder protrudes rearward of a rear end of the driving cylinder, wherein the nail driving direction of the driving mechanism is defined as a forward direction (front) of the driving tool and its opposite is defined as a rearward direction (rear) of the driving tool. Therefore, it is not effective in shortening of the driving tool in the front-rear direction.

The present invention has been made in view of the problem above and it is an object of the present invention to provide a driving tool that enables size reduction.

The above-described problem can be solved by claim 1. A preferred aspect of a driving tool of the present invention includes a first cylinder, a first piston that is disposed so as to be slidable within the first cylinder and is configured to generate compressed air in the first cylinder, a motor that drives the first piston, a second cylinder, a second piston that is disposed so as to be slidable within the second cylinder and has a sliding part and an elongate driving part connected to the sliding part, a handle, and a magazine that is configured to feed the struck material onto an axis of movement of the driving part. The compressed air in the first cylinder is supplied into the second cylinder and the second piston is linearly moved toward a front end of the second cylinder by the compressed air, so that the driving part drives the struck material. Further, the "driving tool" in the present invention corresponds in a representative manner to nailers or tackers. In addition, the "struck material" suitably includes straight rod-like items with a sharp point or to staples having a U-shape. The manner of "feeding the struck material onto the axis of movement of the driving part" by the magazine suitably includes a manner of feeding the material onto the axis of movement of the driving part from a direction perpendicular to the axis of movement, and to a manner of feeding the material onto the axis of movement from a direction oblique to the axis of movement.

Further, the first cylinder is arranged to intersect with the second cylinder and extend alongside the magazine. The first piston is configured to slide in a direction alongside the magazine. The handle is disposed on the opposite side of the first cylinder from the magazine with reference to the direction that the axis of movement of the driving part extends. Further, the magazine in the present invention is configured as an elongate member extending in a prescribed direction so as to store a plurality of materials side by side in the prescribed direction. The manner of arranging the handle suitably includes a manner of arranging it in parallel to the magazine and a manner of arranging it obliquely to the magazine.

According to the present invention, the first cylinder is arranged to intersect with the second cylinder and extend alongside the magazine, and the first piston slides in a direction alongside the magazine. Therefore, in case the direction in which the second piston drives the struck material is defined as a forward direction and its opposite direction is defined as a rearward direction, the first cylinder is precluded from protruding in the rearward direction of the driving tool. As a result, the overall length of the driving tool can be shortened, so that the driving tool is reduced in size.

According to a further aspect of the driving tool of the present invention, the magazine and the first cylinder are disposed at a front end region of the second cylinder. Further, the handle is disposed at a rear end region of the second cylinder on a side opposite to the front end region of the second cylinder.

In known driving tools, the compression cylinder and the driving cylinder are disposed in parallel to each other and the handle is connected to the compression cylinder. Therefore, the handle is located at a distant position from the axis of movement of the driving part disposed within the driving cylinder. According to this embodiment, however, because the handle is disposed at the rear end region of the second cylinder, the handle can be arranged to be located closer to the axis of movement of the driving part. With this arrangement, it is possible to suppress the occurrence of moments around the handle held by the user, which moments are caused by recoil during the driving operation of the struck material. Further, when performing the driving operation of the struck material, a pressing force exerted onto the handle can be efficiently applied to the workpiece.

According to a further aspect of the driving tool of the present invention, the magazine and the first cylinder are disposed adjacent to each other. According to this aspect, by disposing the first cylinder adjacent to the magazine, a further size reduction of the driving tool can be realized.

According to a further aspect of the present invention, the driving tool has a compressed air supply passage that provides communication between the first cylinder and the second cylinder, and a valve member that is disposed in the compressed air supply passage and serves to provide and cut off communication between the first cylinder and the second cylinder. The valve member is disposed in a connecting region, which is connected to the second cylinder, of the compressed air supply passage.

According to this aspect, by disposing the valve member in the connecting region, which is connected to the second cylinder, of the compressed air supply passage, a majority of the compressed air supply passage normally is in communication with the first cylinder. Specifically, the compressed air supply passage can be used as part of the compression chamber. Therefore, the compressed air is prevented from expanding while being supplied into the second cylinder, so that energy losses are reduced.

According to a further aspect of the driving tool of the present invention, the compressed air supply passage is provided alongside a longitudinal axis of the second cylinder. The manner of forming the "compressed air supply passage" suitably includes a manner of integrally forming it as an inner passage inside a wall of the second cylinder and a manner of forming it as a separate member from the second cylinder. In case it is formed as a separate member, the compressed air supply passage is preferably configured as a tubular member.

According to this aspect, by providing the compressed air supply passage alongside the longitudinal axis of the second cylinder, other components for the driving tool can be rationally arranged. Specifically, other components are arranged without interfering with the compressed air supply passage.

According to a further aspect of the driving tool of the present invention, the magazine and the first cylinder are disposed in parallel to each other. Further, as for the manner of being "parallel", it is not necessary to be strictly parallel, but it may be substantially parallel.

According to this aspect, by arranging the magazine and the first cylinder in parallel with each other, it is possible to eliminate waste with regard to installation space.

According to a further aspect of the driving tool of the present invention, a rotation axis of the motor is arranged in parallel to the longitudinal axis of the second cylinder. Further, as for the manner of being "parallel", it is not necessary to be strictly parallel, and it may be substantially parallel.

According to a further aspect of the present invention, the driving tool has an operating member that is manually operated by a user in order to control the motor. The first cylinder, the second cylinder, the handle and the motor are arranged to form a hollow space surrounded by the four parts. The operating member is arranged to project into the hollow space. The operating member suitably includes a trigger and a switch, which are operated by the user. Further, the operating member is preferably mounted on the handle, and more preferably is disposed in a region of the handle that is adjacent to the second cylinder.

According to this aspect, by forming the hollow space surrounded by the first cylinder, the second cylinder, the handle and the motor, strength against external forces that act on the driving tool inwardly from outside of the hollow space is increased. Further, because the operating member is arranged to project into the hollow space, the operating member is protected from the external forces. In addition, in case the operating member is disposed in the region of the handle that is adjacent to the second cylinder, the operating member can be easily operated by the user holding the handle.

According to a further aspect of the driving tool of the present invention, the first cylinder, the second cylinder, the handle and the motor are arranged to form a quadrilateral having the four members as its respective sides. According to this aspect, strength against external forces acting on the driving tool is increased.

According to a further aspect of the driving tool of the present invention, one end of the handle is connected to the second cylinder. In addition, the handle is arranged to extend in a crossing direction that crosses a longitudinal direction of the second cylinder. The motor and a battery that supplies power to the motor are disposed on the other end of the handle in the crossing direction.

According to this aspect, by disposing the motor and the battery at the other end of the handle, the parts of the electrical system are rationally disposed adjacent to each other. Further, in case the weight ratio of the motor and the battery, which are disposed at the other end of the handle, to the second cylinder which is connected to the one end of the handle, is set to about one, the center of gravity of the driving tool is located substantially in the middle of the handle, so that operability of the driving tool is improved.

According to the present invention, an improved driving tool is provided that enables size reduction.

Other objects, features and advantages of this invention will be readily understood after reading the following detailed description together with the accompanying drawings and the claims.

DETAILED DESCRIPTION

Each of the additional features and method steps disclosed above and below may be utilized separately or in conjunction with other features and method steps to provide improved driving tools and devices utilized therein. Representative examples of this invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
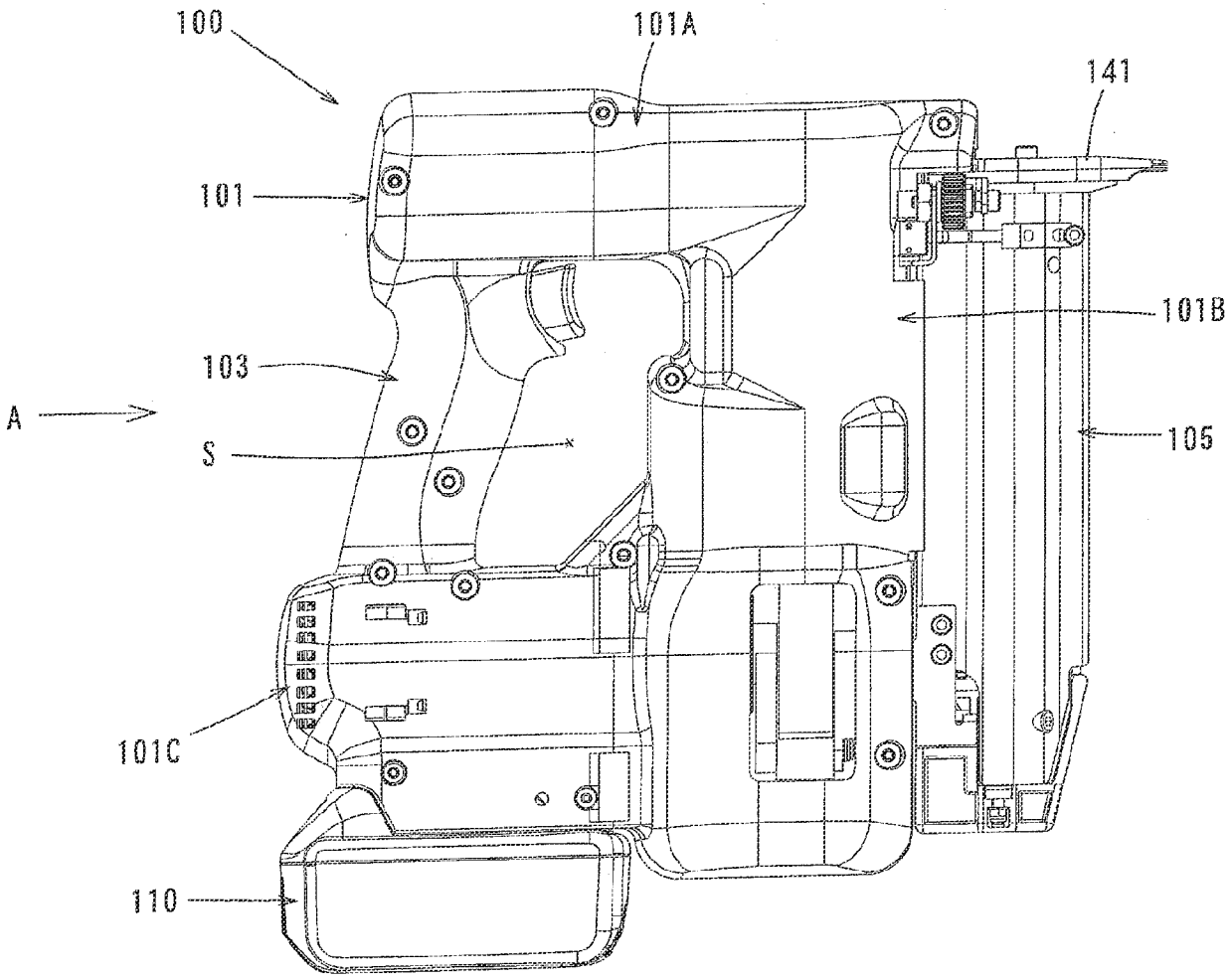
FIG. 1 is an external view showing the overall structure of a nailer.
Figure 2:
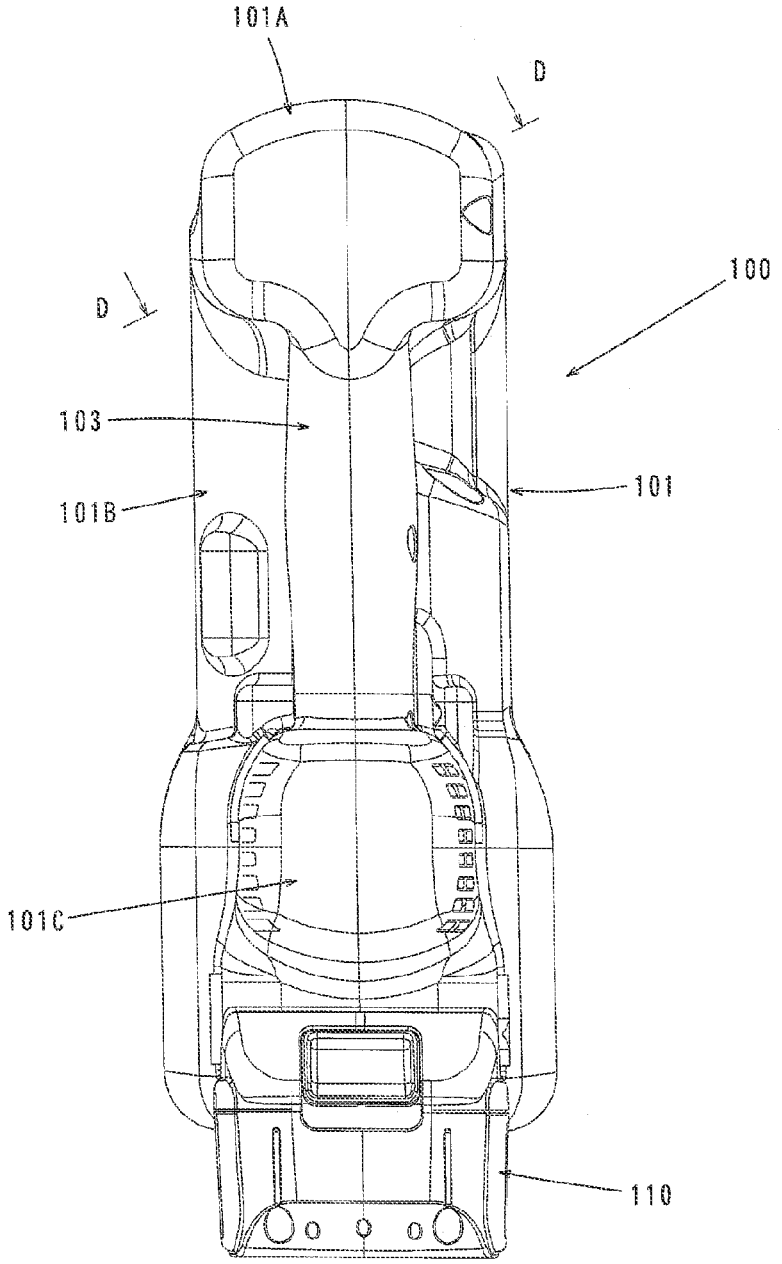
FIG. 2 is a view as seen from arrow A in FIG. 1.

An embodiment of the present invention will now be described with reference to FIGS. 1 to 11. This embodiment will be explained using an electric-pneumatic nailer as one example of a driving tool according to the present invention. As shown in FIGS. 1 and 2, a nailer 100 mainly includes a body housing 101 serving as a tool body that forms an outer shell of the nailer 100, and a magazine 105 that stores nails (not shown) serving as a struck material to be driven into a workpiece. The body housing 101 is formed by joining together a pair of substantially symmetrical housings. The body housing 101 integrally has a handle 103 to be held by a user, a driving mechanism housing part 101A for housing a nail driving mechanism 120 (see FIG. 3), a compression device housing part 101B for housing a compression device 130 (see FIG. 3) and a motor housing part 101C for housing an electric motor 111 (see FIG. 7).

The handle 103, the driving mechanism housing part 101A, the compression device housing part 101B and the motor housing part 101C of the body housing 101 are arranged to form a generally quadrilateral shape having these four parts as its respective sides. Specifically, the handle 103 and the compression device housing part 101B are arranged to form one pair of opposed sides, and the driving mechanism housing part 101A and the motor housing part 101C are arranged to form the other pair of opposed sides, so that the four parts form a quadrilateral shape such as a rectangle, square, trapezoid or parallelogram shape. Further, it is not necessary for all of the four parts to extend in a straight line; for example, the handle 103 may be formed to extend in a curved line. The handle 103 is an elongate member having a prescribed length; one end of the handle 103 in its direction of extension is connected to one (rear) end region of the driving mechanism housing part 101A and the other end in its direction of extension is connected to one (rear) end region of the motor housing part 101C. The compression device housing part 101B is arranged to extend substantially in parallel to the handle 103; one end of the compression device housing part 101B in its direction of extension is connected to the other (front) end region of the driving mechanism housing part 101A and the other (front) end region in its direction of extension is connected to the other (front) end region of the motor housing part 101C. Thus, the handle 103, the driving mechanism housing part 101A, the compression device housing part 101B and the motor housing part 101C define an approximately quadrilateral space S. The handle 103 is an example embodiment that corresponds to the "handle" according to the present invention.

FIG. 1 shows a nail driving direction (discharge direction) in which a nail is driven in the rightward direction in FIG. 1 through a driver guide 141 disposed at a front end (right end as viewed in FIG. 1) of the nailer 100. The nail driving direction is a nail striking direction in which a driver 125 (see FIG. 3) strikes the nail. Further, for the sake of convenience of explanation, the front end side of the nailer 100 (the right as viewed in FIG. 1) is taken as the front or front side and its opposite side is taken as the rear or rear side. The side of a connection between the handle 103 and the driving mechanism housing part 101A (upper side as viewed in FIG. 1) is taken as the top or upper side and the side of a connection between the handle 103 and the motor housing part 101C (lower side as viewed in FIG. 1) is taken as the bottom or lower side.

Figure 3:
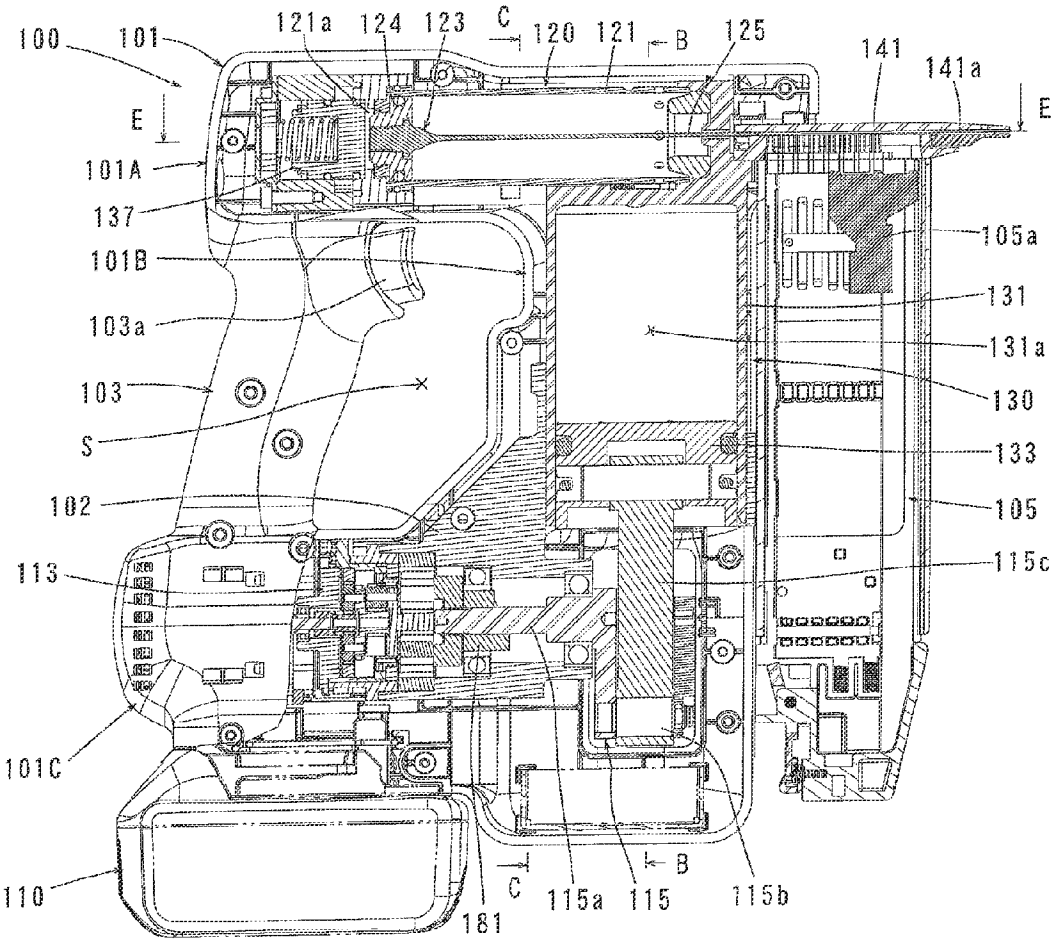
FIG. 3 is a sectional view showing the overall structure of the internal mechanisms of the nailer.

As shown in FIG. 3, the nail driving mechanism 120 is housed in the driving mechanism housing part 101A of the body housing 101. The nail driving mechanism 120 mainly includes a driving cylinder 121 and a driving piston 123. The driving cylinder 121 and the driving piston 123 are example embodiments that correspond to the "second cylinder" and the "second piston", respectively, according to the present invention.

The driving piston 123 that drives nails is housed in the driving cylinder 121 such that it is slidable in the front-rear directions. The driving piston 123 includes a piston body 124 that is disposed so as to be slidable in the driving cylinder 121, and an elongate driver 125 that is integrally formed with the piston body 124 and extends forward from the piston body 124. Further, the driving piston 123 linearly moves in the longitudinal direction of the driving cylinder 121 by compressed air that is supplied into a cylinder chamber 121*a*. Thus, the driver 125 moves forward within a driving passage 141*a* formed in the driver guide 141 and drives the nail. The piston body 124 and the driver 125 are example embodiments that correspond to the "sliding part" and the "driving part", respectively, according to the present invention. The cylinder chamber 121*a* is defined as a space surrounded by an inner wall surface of the driving cylinder 121 and a rear surface of the piston body 124.

The driver guide 141 is provided at the front end (right end as viewed in FIG. 3) of the driving cylinder 121. The magazine 105 is an elongate rectangular member that stores nails. The magazine 105 is disposed at the front end of the body housing 101 or in front of the compression device housing part 101B and is connected to the driver guide 141. Further, the magazine 105 has a pusher plate 105*a* for pushing the nails upward as viewed in FIG. 3. The pusher plate 105*a* feeds the nails one by one into the driving passage 141*a* of the driver guide 141.

As shown in FIG. 3, the compression device 130 is housed in the compression device housing part 101B of the body housing 101. The compression device 130 mainly includes a compression cylinder 131 and a compression piston 133 that is disposed in the compression cylinder 131 and can slide in the vertical direction. The compression cylinder 131 and the compression piston 133 are example embodiments that correspond to the "first cylinder" and the "first piston", respectively, according to the present invention.

The compression cylinder 131 is disposed in parallel alongside the magazine 105. Specifically, the compression cylinder 131 is disposed alongside the longitudinal direction of the magazine 105 and an upper end of the compression cylinder 131 is integrally connected to a front end portion of the driving cylinder 121. The compression piston 133 is arranged to slide in the vertical direction along the magazine 105, and the sliding direction of the compression piston 133 is substantially perpendicular to the sliding direction of the driving piston 123. The volume of a compression chamber 131*a* in the compression cylinder 131 is changed by the sliding movement of the compression piston 133 in the vertical direction. When the compression piston 133 moves upward, the compression piston 133 compresses air in the compression chamber 131*a*. The compression chamber 131*a* is defined as a space surrounded by an inner wall surface of the compression cylinder 131 and an upper surface of the compression piston 133, and is provided adjacent to the driving cylinder 121 in an upper region of the compression cylinder 131.

As shown in FIG. 3, the electric motor 111 (see FIG. 7) for driving the compression device 130 is housed in the motor housing part 101C of the body housing 101. The electric motor 111 is arranged such that its rotation axis extends substantially in parallel to the axis of the driving cylinder 121. Therefore, the rotation axis of the electric motor 111 is perpendicular to the sliding direction of the compression piston 133. Further, a battery mounting region is provided on a lower end of the motor housing part 101C, and a rechargeable battery pack 110 from which the electric motor 111 is powered is attached to this battery mounting region. The battery pack 110 is an example embodiment that corresponds to the "battery" according to the present invention.

The speed of rotation of the electric motor 111 is reduced by a planetary gear type, speed reducing mechanism 113 and then the rotation is converted into linear motion by a crank mechanism 115 serving as a motion converting mechanism and is transmitted to the compression piston 133. Specifically, the compression device 130 is provided that mainly includes the compression cylinder 131, the compression piston 133 and the crank mechanism 115. Further, the speed reducing mechanism 113 and the crank mechanism 115 are housed in an inner housing 102 (also referred to as a gear housing), which is provided in the compression device housing part 101B and the motor housing part 101C.

The crank mechanism 115 mainly includes a crank shaft 115*a*, an eccentric pin 115*b* and a connecting rod 115*c*. The crank shaft 115*a* is rotated by the planetary gear type, speed reducing mechanism 113. The eccentric pin 115*b* is provided at a position displaced from the center of rotation of the crank shaft 115*a*. One end of the connecting rod 115*c* is connected to the eccentric pin 115*b* so as to be relatively rotatable, and the other end is connected to the compression piston 133 so as to be relatively rotatable. The crank mechanism 115 is disposed below the compression cylinder 131.

The electric motor 111 is controlled to start and stop by a trigger 103*a* provided on the handle 103 and by the driver guide 141 serving as a contact arm provided in a front end region of the body housing 101. Specifically, the trigger 103*a*, which can be operated by the user's finger, and a trigger switch 103*b* (see FIG. 7) are provided on the handle 103; the trigger switch 103*b* is turned on and off by depressing and releasing the trigger 103*a*. When the trigger switch 103*b* is turned on, the electric motor 111 is energized. On the other hand, when the trigger switch 103*b* is turned off, the electric motor 111 is stopped. The trigger 103*a* is arranged to project inward from the handle 103 into the approximately quadrilateral space S surrounded by the handle 103, the driving mechanism housing part 101A, the compression device housing part 101B and the motor housing part 101C, that is to say, the hollow space surrounded by the driving cylinder 121, the compression cylinder 131, the handle 103 and the electric motor 111. The trigger 103*a* is an example embodiment that corresponds to the "operating member" according to the present invention.

Figure 8:
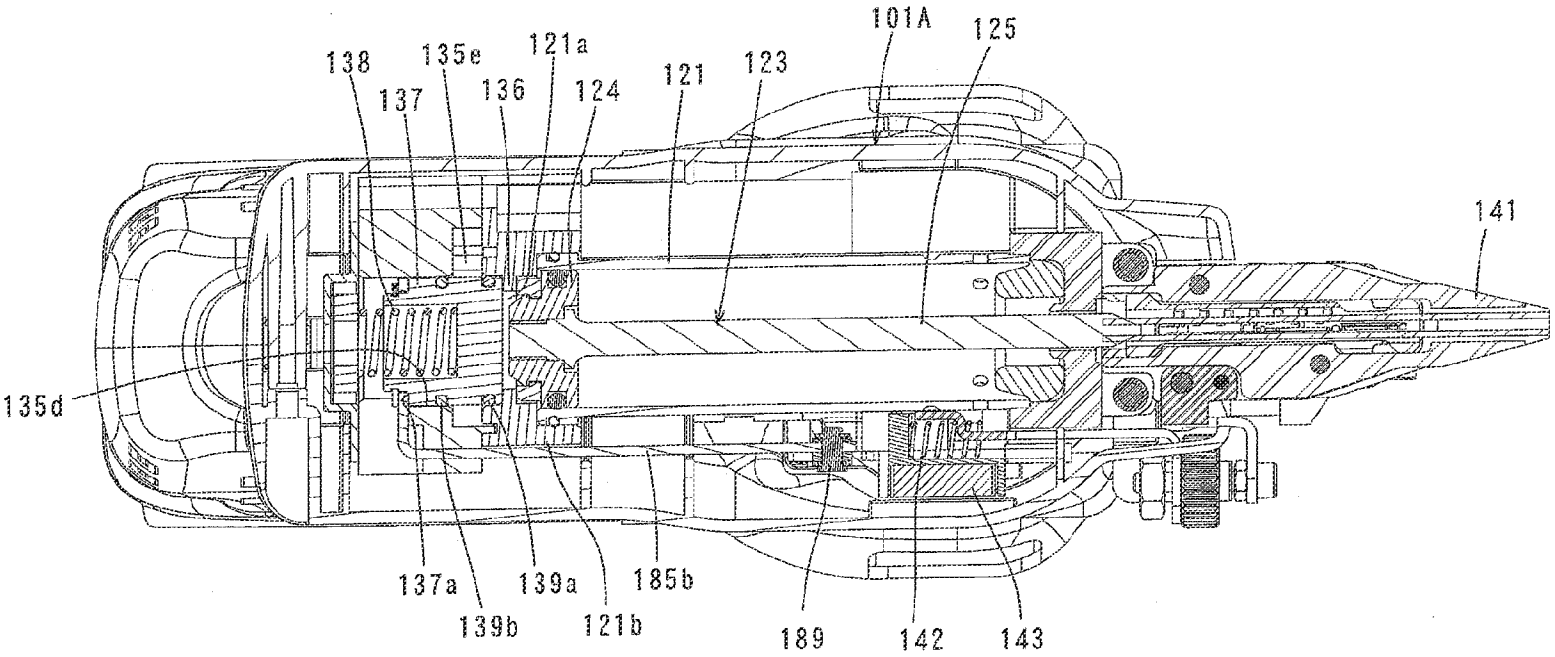
FIG. 8 is a sectional view taken along line E-E in FIG. 3 and showing a state in which the valve is located at a forward position to cut off communication between a compression chamber and a cylinder chamber.

The driver guide 141 that serves as the contact arm is arranged such that it can move in the nail driving direction, and is biased towards the front (forward) by a biasing spring 142 (see FIG. 8). When the driver guide 141 is located at a front position, a contact arm switch 143 (see FIG. 8) is turned off. When the driver guide 141 is moved toward the body housing 101 side (to a rear position), the contact arm switch 143 is turned on. The electric motor 111 is energized when both the trigger switch 103*b* and the contact arm switch 143 are turned on, whereas the electric motor 111 is stopped when either one or both of the trigger switch 103*b* and the contact arm switch 143 is/are turned off.

Figure 6:
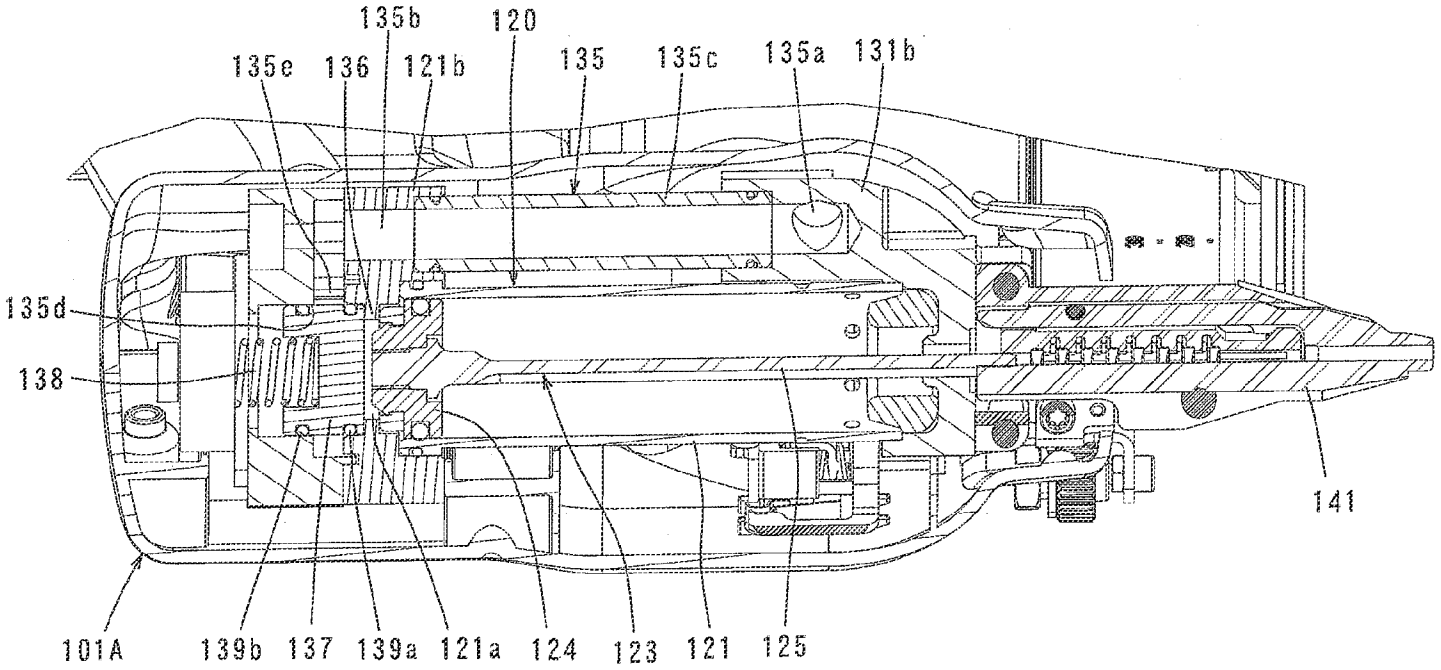
FIG. 6 is a sectional view taken along line D-D in FIG. 2.

As shown in FIG. 6, the nailer 100 has an air passage 135 that provides communication between the compression chamber 131*a* (see FIG. 3) of the compression cylinder 131 and the cylinder chamber 121*a* of the driving cylinder 121, and a valve 137 that opens and closes the air passage 135. The air passage 135 and the valve 137 are example embodiments that correspond to the "compressed air supply passage" and the "valve member", respectively, according to the present invention. When the driving piston 123 is moved to a rear end position (to the left as viewed in FIG. 3) and the compression piston 133 is moved to a lower end position (bottom dead center) as shown in FIG. 3, the nailer 100 is defined as being located in the initial position. Specifically, the position where the crank angle is zero degrees is the bottom dead center and is defined as the initial position.

Figure 4:
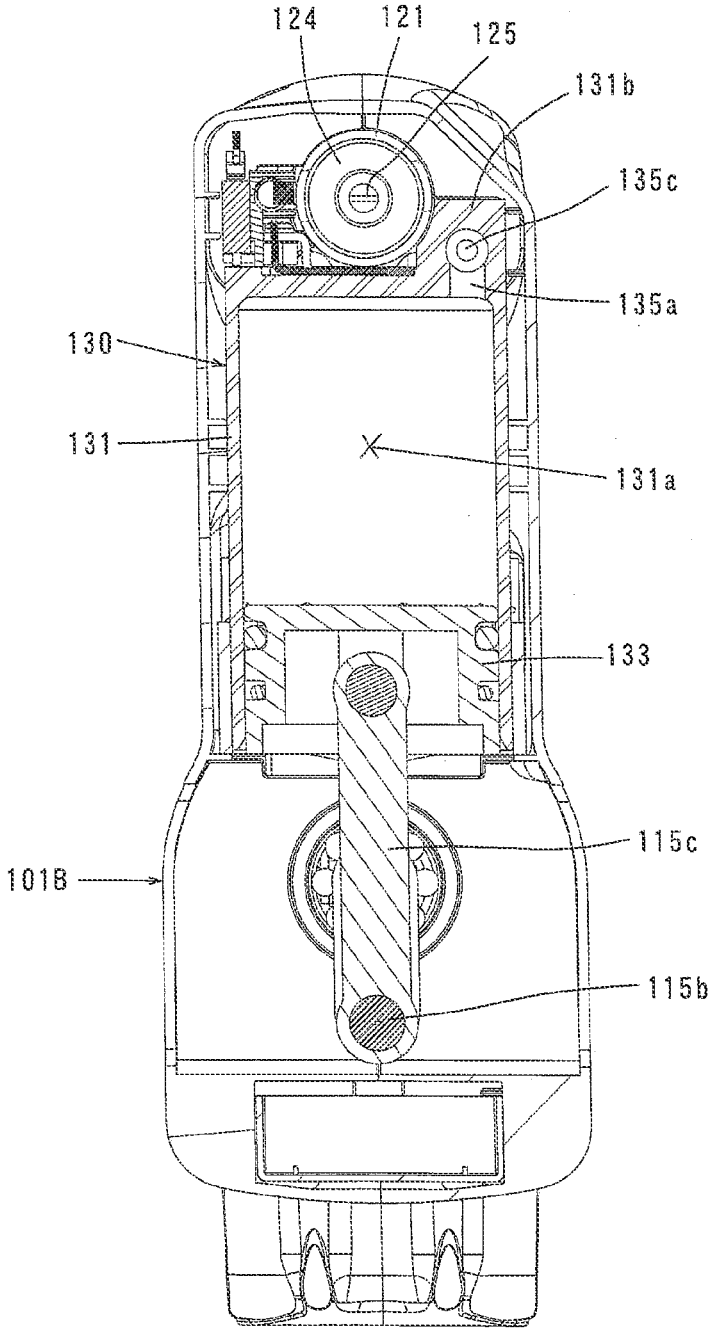
FIG. 4 is a sectional view taken along line B-B in FIG. 3.
Figure 5:
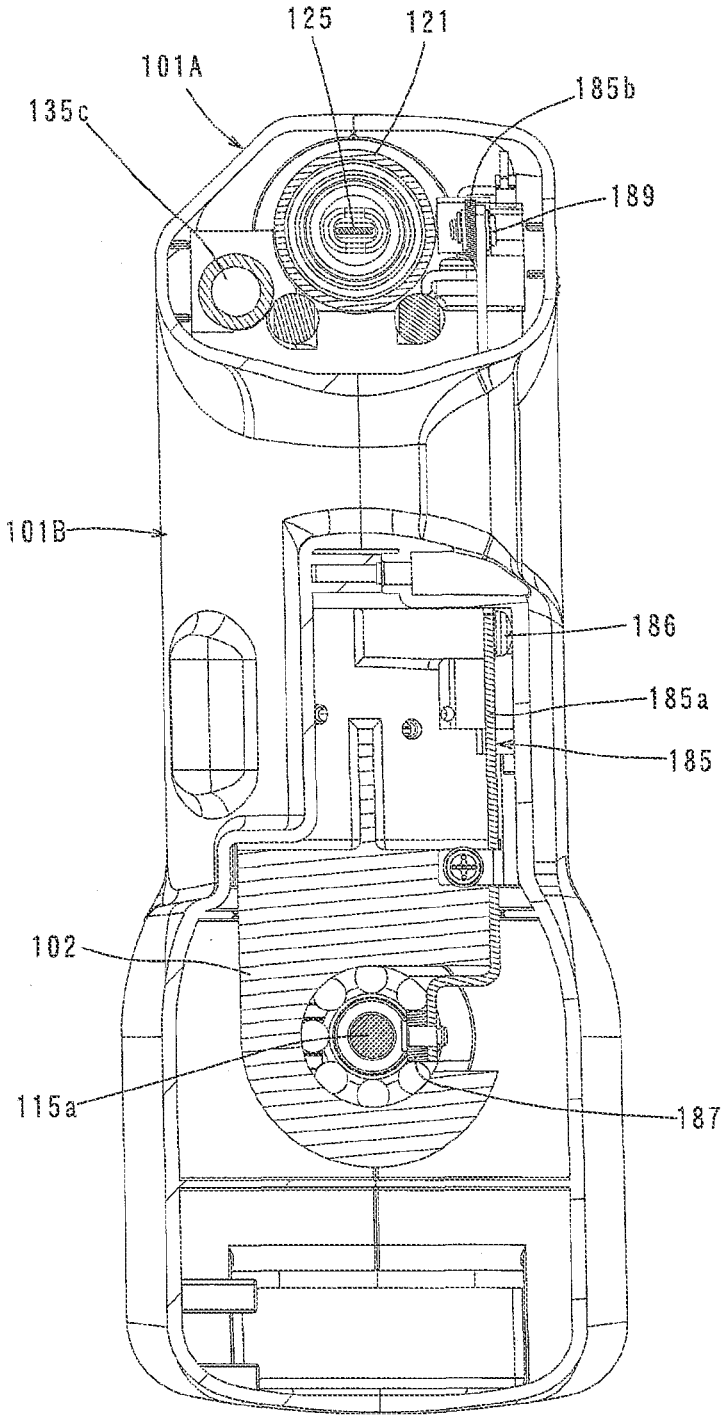
FIG. 5 is a sectional view taken along line C-C in FIG. 3.

As shown in FIG. 6, the air passage 135 mainly includes a communication port 135*a* open to the compression cylinder 131 side, a communication port 135*b* open to the driving cylinder 121 side, a communication path 135*c* that communicates between the communication ports 135*a*, 135*b*, a valve housing space 135*d* and an annular groove 135*e* formed in an inner circumferential surface of the valve housing space 135*d*. As shown in FIG. 4, the communication port 135*a* is formed in a cylinder head 131*b* of the compression cylinder 131 and communicates with the compression chamber 131*a*. As shown in FIG. 6, the communication port 135*b* is formed in a cylinder head 121*b* of the driving cylinder 121. One end of the communication port 135*b* communicates with the communication path 135*c*, and the other end communicates with the annular groove 135*e*. Specifically, the communication port 135*b* communicates with the valve housing space 135*d* via the annular groove 135*e*. As shown in FIG. 6, the communication path 135*c* is formed by a pipe-like member and extends in the front-rear direction along the driving cylinder 121. One end of the communication path 135*c* communicates with the communication port 135*a* and the other end communicates with the communication port 135*b*.

As shown in FIG. 6, the valve 137 is disposed in the valve housing space 135*d*. The valve housing space 135*d* has substantially the same inner diameter as the cylinder chamber 121*a* and is formed in the cylinder head 121*b* so as to communicate with the cylinder chamber 121*a*. Therefore, the valve 137 disposed in the valve housing space 135*d* is configured as a columnar member having substantially the same diameter as the piston body 124 of the driving piston 123 and arranged to be movable in the front-rear directions on the same axis as a nail-driving axis line (axis of movement) of the driver 125 of the driving piston 123. By moving in the front-rear directions, the valve 137 provides communication between the compression chamber 131*a* and the cylinder chamber 121*a* or cuts off the communication. In other words, the valve 137 opens and closes the air passage 135.

Figure 9:
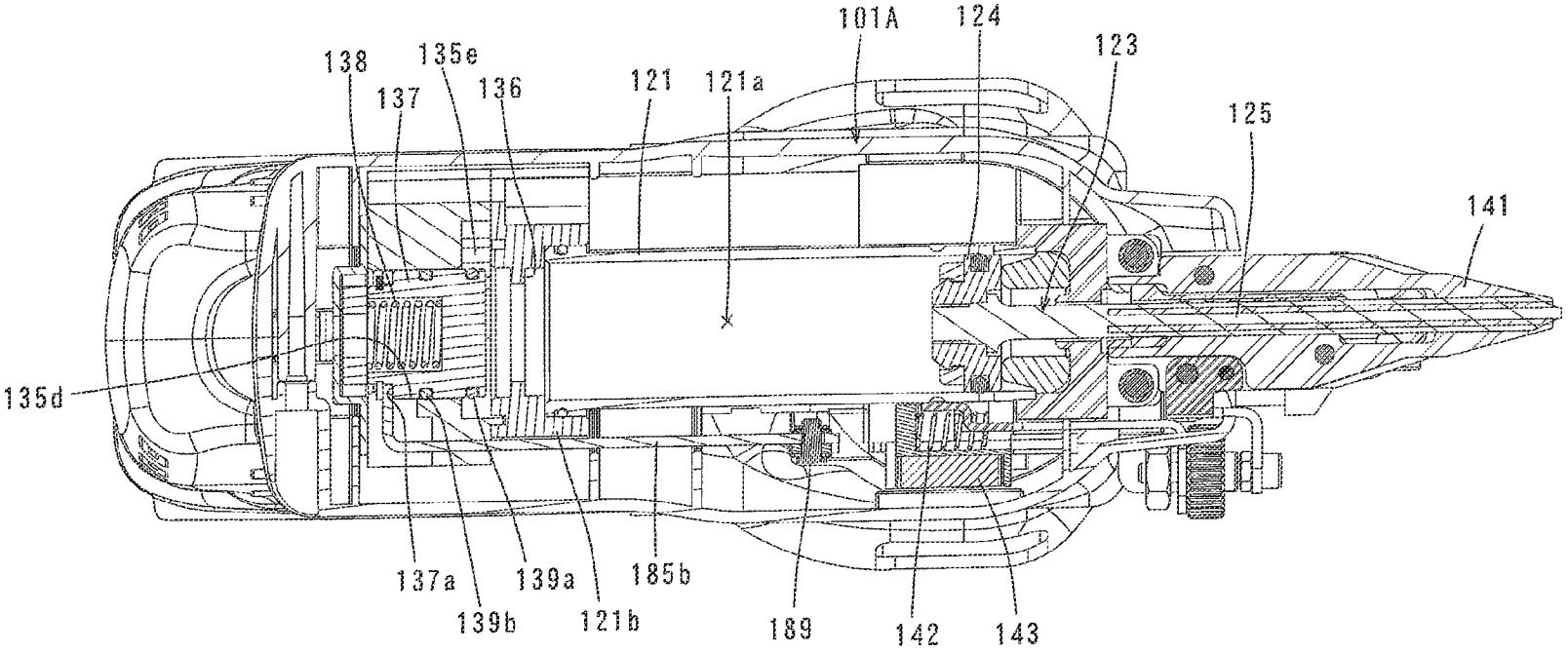
FIG. 9 is a sectional view showing a nail driving state in which the valve is located at a rear position to provide communication between the compression chamber and the cylinder chamber, and a driving piston is moved forward.
Figure 10:
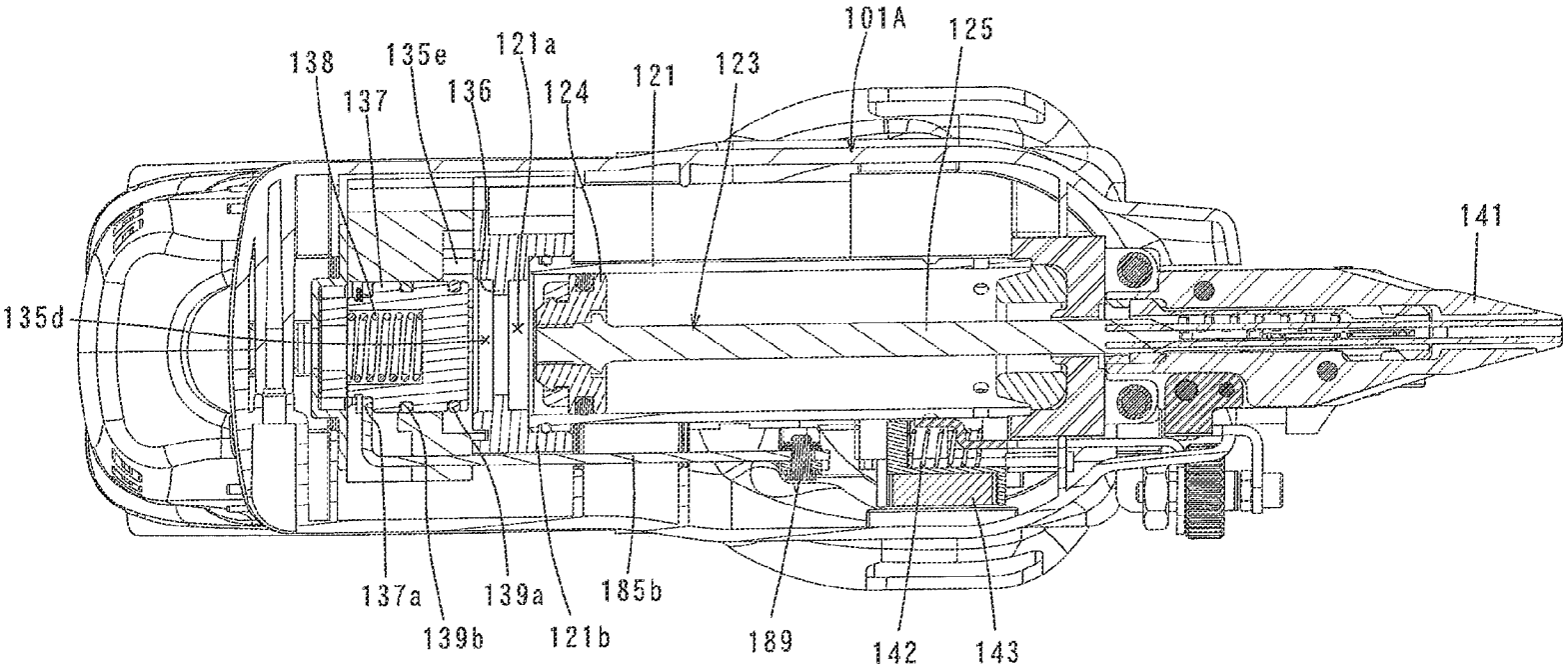
FIG. 10 is a sectional view showing a state in which the communication between the compression chamber and the cylinder chamber is maintained and the driving piston is returned near to a rear initial position.

Specifically, as shown in FIGS. 8 to 10, two O-rings 139*a*, 139*b* are provided on an outer periphery of the valve 137, spaced apart in the front-rear direction. When the front O-ring 139*a* is positioned in front of the annular groove 135*e* and in contact with an inner wall surface of the valve housing space 135*d*, communication between the compression chamber 131*a* and the cylinder chamber 121*a* is cut off. Further, when the O-ring 139*a* is moved into the region of the annular groove 135*e* that is spaced from the inner wall surface of the valve housing space 135*d*, the compression chamber 131*a* and the cylinder chamber 121*a* communicate with each other. FIG. 8 shows the state in which the air passage 135 is closed by the valve 137, and FIGS. 9 and 10 show the state in which the air passage 135 is opened by the valve 137. Further, the rear O-ring 139*b* is provided to prevent the compressed air from leaking out through the communication port 135*b* and has no involvement in the communication between the compression chamber 131*a* and the cylinder chamber 121*a*. As described above, the valve 137 is provided in a connecting region, which connects with the cylinder chamber 121*a* of the driving cylinder 121, of the air passage 135.

As shown in FIGS. 8 to 10, the valve 137 is normally biased forward by a compression coil spring 138 so as to cut off communication between the compression chamber 131*a* and the cylinder chamber 121*a*. Further, a stopper 136 is provided in front of the valve 137. The stopper 136 is formed by a flange-like member projecting radially inward into the cylinder chamber 121*a* and defines the rear end position of the driving piston 123, which moves rearward after a driving operation. Further, the stopper 136 defines the front end position of the valve 137 biased forward by the compression coil spring 138.

Figure 11:
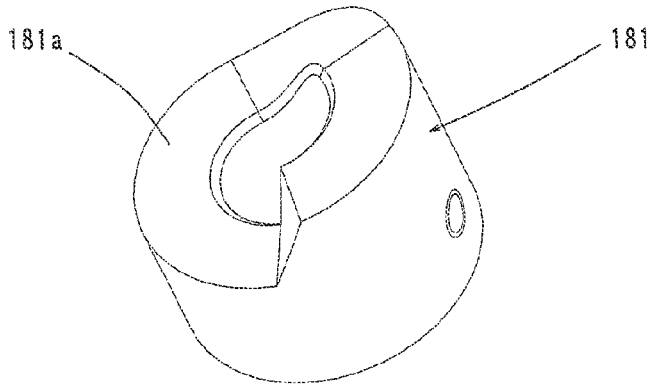
FIG. 11 is a perspective view showing a cylindrical cam.

The valve 137 is configured as a mechanical valve to be controlled by a cylindrical cam 181 (see FIGS. 3 and 11) which rotates in conjunction with the crank mechanism 115. Rotation of the cylindrical cam 181 is converted into linear motion in the front-rear directions by a link mechanism 185 serving as a relay member and is then transmitted to the valve 137. As shown in FIG. 11, the cylindrical cam 181 is an end face cam having a cam face 181*a* on one side in its axial direction. As shown in FIG. 3, the cylindrical cam 181 is fitted onto the crank shaft 115*a* and rotates together with the crank shaft 115*a*. The cam face 181*a* is shaped such that the valve 137 is moved rearward and provides communication between the compression chamber 131*a* and the cylinder chamber 121*a* when the air in the compression chamber 131*a* is compressed to the maximum (the crank angle is 180 degrees).

Figure 7:
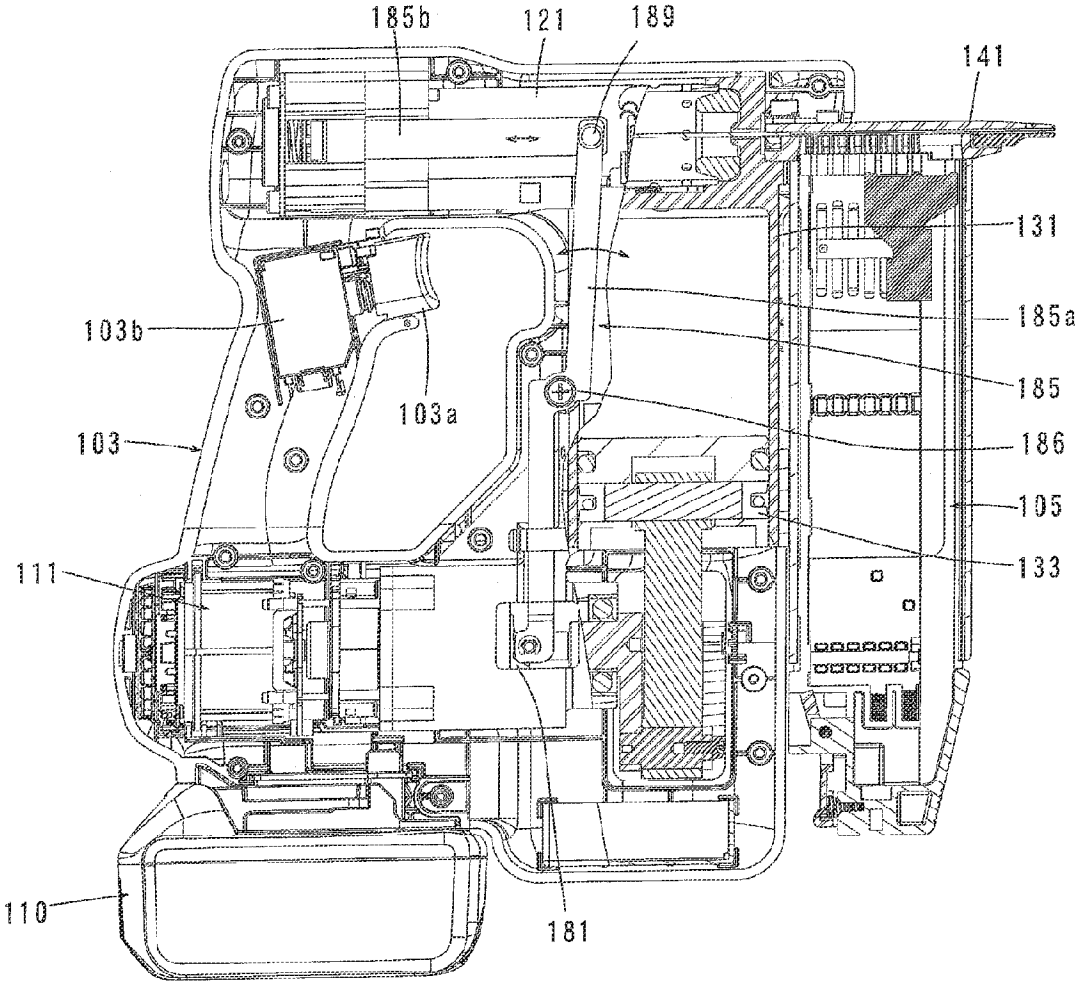
FIG. 7 is a view showing a link mechanism for moving a valve.

As shown in FIG. 7, the link mechanism 185 includes a first link 185*a* and a second link 185*b*. The first link 185*a* is disposed to extend in the vertical direction along a lateral surface of the compression cylinder 131. The first link 185*a* is supported substantially at its center in the vertical direction on the inner housing 102 by a support shaft 186 such that the first link 185*a* is pivotable in the front-rear direction. A lower end of the first link 185*a* is in contact with the cam face of the cylindrical cam 181 via a cam follower 187 (see FIG. 5). The second link 185*b* is disposed along a lateral surface of the driving cylinder 121 such that it is movable in the front-rear directions. As shown in FIGS. 8 to 10, one end (front end) of the second link 185*b* is connected to an upper end of the first link 185*a* by a pin 189 so as to be relatively rotatable. Further, the other end (rear end) of the second link 185*b* is engaged with an annular engagement recess 137*a* formed in the outer periphery of the valve 137.

Therefore, as shown in FIG. 7, when the upper end portion of the first link 185*a* is pivoted forward about the support shaft 186 and the second link 185*b* is moved forward, the valve 137 is moved forward and cuts off communication between the compression chamber 131*a* and the cylinder chamber 121*a* (see FIG. 8). On the other hand, when the upper end portion of the first link 185*a* is pivoted rearward and the second link 185*b* is moved rearward, the valve 137 is moved rearward and provides communication between the compression chamber 131*a* and the cylinder chamber 121*a* (see FIG. 9). Further, the biasing force of the compression coil spring 138, which biases the valve 137 forward, acts in a direction that presses the cam follower 187 against the cam face 181*a* of the cylindrical cam 181.

In the nailer 100 constructed as described above, which is in the initial position as shown in FIG. 3, when the contact arm switch 143 (see FIG. 8) is turned on by pressing the driver guide 141 against the workpiece and the trigger switch 103*b* (see FIG. 7) is turned on by depressing the trigger 103*a*, the electric motor 111 is energized. Thus, the crank mechanism 115 is driven via the speed reducing mechanism 113 and the compression piston 133 is moved upward. At this time, as shown in FIGS. 3 and 8, communication between the compression chamber 131*a* and the cylinder chamber 121*a* is kept cut off by the valve 137, so that the air in the compression chamber 131*a* is compressed.

When the compression piston 133 reaches near the top dead center or when the air in the compression chamber 131*a* is compressed to the maximum, the valve 137 is moved rearward via the cylindrical cam 181 and the link mechanism 185, so that the compression chamber 131*a* and the cylinder chamber 121*a* communicate with each other. When the compression chamber 131*a* and the cylinder chamber 121*a* communicate with each other, the compressed air in the compression chamber 131*a* is supplied into the cylinder chamber 121*a*, so that the valve 137 is moved to the rear end position as shown in FIG. 9. At the same time, the driving piston 123 is moved forward by the compressed air supplied into the cylinder chamber 121*a*. Then the driver 125 of the driving piston 123 strikes the nail in the driving passage 141*a* of the driver guide 141 and drives it into the workpiece.

The compression piston 133 moves downward after the compressing operation. At this time, the volume of the compression chamber 131*a* is increased so that the pressure in the compression chamber 131*a* is reduced. The pressure in the compression chamber 131*a* acts on the driving piston 123 via the air passage 135 and the cylinder chamber 121*a*. By this pressure reduction, as shown in FIG. 10, air in the cylinder chamber 121*a* is sucked into the compression chamber 131*a*, and the driving piston 123 is moved rearward and comes into contact with the stopper 136. Thus, the driving piston 123 is returned to the initial position. The valve 137 maintains the communication between the compression chamber 131*a* and the cylinder chamber 121*a* until the driving piston 123 has returned to the initial position. However, when the compression piston 133 comes close to the initial position or the bottom dead center, the valve 137 is moved forward by the biasing force of the compression coil spring 138 and cuts off the communication between the compression chamber 131*a* and the cylinder chamber 121*a*. Further, when the compression piston 133 is returned to the initial position, the supply of current to the electric motor 111 is interrupted and the electric motor 111 is stopped even if the trigger switch 103*b* and the contact arm switch 143 are held in the on state. One cycle of the nail driving operation is completed in this manner.

According to the above-described embodiment, the compression cylinder 131 and the compression piston 133, which form the compression device 130, are disposed alongside the magazine 105. Specifically, the compression device 130 is disposed in the front region of the nailer 100, thereby avoiding that the compression device 130 protrudes rearward of the nailer 100. As a result, the length of the nailer 100 in the front-rear direction or the overall length of the nailer 100 is shortened, so that a size reduction of the nailer 100 can be realized.

In addition, according to this embodiment as well, because the compression device 130 is disposed in the front region of the nailer 100, the degree of freedom increases in the arrangement and configuration of the handle 103 that is disposed at the rear region of the driving cylinder 121. Specifically, the handle 103 is arranged to be located closer to the nail-driving axis line of the driver 125. Therefore, the recoil force generated during the nail driving operation by the driver 125 can be easily controlled by the user's hand. In addition, the user can efficiently apply a pressing force against the workpiece. Further, the trigger 103*a* on the handle 103 can also be disposed closer to the driving cylinder 121. Therefore, the operability of the trigger 103 can be improved.

In addition, according to this embodiment, because the magazine 105 and the compression cylinder 131 are disposed adjacent to each other, a rational arrangement can be realized with no dead space. In this case, the magazine 105 and the compression cylinder 131 are preferably disposed in parallel to each other. Therefore, for example, in the nailer 100 in which the magazine 105 is disposed obliquely to the nail-driving axis line of the driver 125, the compression cylinder 131 is also disposed obliquely to the nail-driving axis line.

In addition, according to this embodiment, because the communication path 135*c* connects the compression chamber 131*a* of the compression cylinder 131 and the cylinder chamber 121*a* of the driving cylinder 121, the degree of freedom increases in the relative arrangement of the compression cylinder 131 and the driving cylinder 121. In this case, the cylindrical member forming the communication path 135*c* is disposed alongside the driving cylinder 121, so that the cylindrical member avoids interference with other components. Further, the cylindrical member may be formed of a hard material or may be formed of a flexible material, which can be freely bent during assembly.

In addition, in this embodiment, in the air passage 135 that connects the compression chamber 131*a* of the compression cylinder 131 and the cylinder chamber 121*a* of the driving cylinder 121, the valve 137 is disposed in a connecting region that connects with the cylinder chamber 121*a*. Thus, the air passage 135 forms a portion of the compression chamber 131*a*. Therefore, while the compressed air is being supplied into the cylinder chamber 121*a* of the driving cylinder 121, the compressed air is prevented from expanding. Specifically, energy losses of the compressed air are reduced. As a result, the nail driving operation is performed with excellent energy efficiency.

In addition, according to this embodiment, because the compression cylinder 131, the driving cylinder 121, the handle 103 and the electric motor 111 are arranged to form an approximately quadrilateral shape and are connected to each other, the stiffness of the nailer 100 can be increased. Therefore, damage to the nailer 100 by external forces is prevented.

In addition, according to this embodiment, the electric motor 111 and the battery pack 110 are disposed at the lower end side of the handle 103. Thus, the electrical system can be rationally arranged all in one region. Further, in case the weight ratio of the electric motor 111 and the battery pack 110, which are provided at the lower end side of the handle 103, to the driving cylinder 121, which is connected to the upper end of the handle 103, is set to about one, the center of gravity of the nailer 100 is set substantially in the middle of the handle 103, so that operability of the nailer 100 is improved.

In the above-described embodiment, the cylindrical cam 181 is configured as an end face cam, but a cylindrical grooved cam having a groove on its outer circumferential surface may be used in place of the end face cam.

Figure 12:
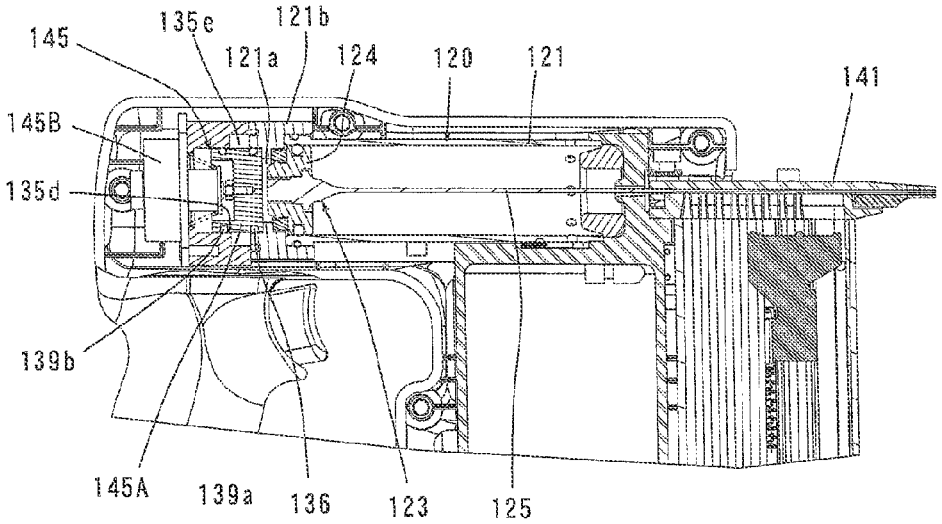
FIG. 12 is a sectional view showing a modification to the valve.

In addition, in the above-described embodiment, the valve 137 is configured as a mechanical valve which is controlled by the cylindrical cam 181, but it is not limited thereto. For example, as shown in FIG. 12, an electrically controllable solenoid valve 145 may be used in place of the mechanical valve. The solenoid valve 145 mainly includes a valve body 145A, which can move in the front-rear directions, and an electromagnet 145B that moves the valve body 145A. For example, when the air in the compression chamber 131*a* is compressed to the maximum, the electromagnet 145B moves the valve body 145*a* rearward and provides communication between the compression chamber 131*a* and the cylinder chamber 121*a*. Further, when the compression piston 133 comes close to the bottom dead center, the electromagnet 145B moves the valve body 145*a* forward and cuts off the communication between the compression chamber 131*a* and the cylinder chamber 121*a*. By provision of a position sensor, for example, that detects the rotational position of the crank shaft 115*a* of the crank mechanism 115, which drives the compression piston 133, the electromagnet 145B is controlled by a controller based on the detected rotational position of the crank shaft 115*a*.

Although the above-described embodiment described the nailer 100 as an example of the driving tool, it may also be applied to driving tools, other than nailers, known as tackers and staplers.

In view of the object of the above-described invention, driving tools according to the present invention can be configured according to the following aspects.

(Aspect 1)

A driving tool that performs a driving operation of a struck material, comprising:

a first cylinder, a first piston that is disposed so as to be slidable within the first cylinder and generates compressed air in the first cylinder, a motor that drives the first piston, a second cylinder, a second piston that is disposed so as to be slidable within the second cylinder and has a sliding part and an elongate driving part connected to the sliding part, a handle, and a magazine that is configured to feed the struck material onto an axis of movement of the driving part, wherein:

the compressed air in the first cylinder is supplied into the second cylinder and the second piston is linearly moved toward a front end of the second cylinder by the compressed air, whereby the driving part drives the struck material, and the first cylinder is arranged to intersect a longitudinal axis of the second cylinder and extend alongside a longitudinal axis of the magazine, the first piston is configured to slide in a direction alongside the longitudinal axis of the magazine, and the handle is disposed on an opposite side of the first cylinder from the magazine with reference to the direction that the axis of movement of the driving part extends.

(Aspect 2)

The driving tool as defined in claim 1 or Aspect 1, wherein the first cylinder is disposed in parallel to the magazine.

(Correspondences Between the Features of the Embodiment and the Features of the Invention)

The above-described embodiment is merely an example of a mode for carrying out the present invention. Accordingly, the present invention is not limited to the structure of the embodiment. Correspondences between the features of the embodiment and the features of the invention are as follows.

The nailer 100 is an example embodiment that corresponds to the "driving tool" according to the present invention.

The handle 103 is an example embodiment that corresponds to the "handle" according to the present invention.

The trigger 103*a* is an example embodiment that corresponds to the "operating member" according to the present invention.

The magazine 105 is an example embodiment that corresponds to the "magazine" according to the present invention.

The battery pack 110 is an example embodiment that corresponds to the "battery" according to the present invention.

The electric motor 111 is an example embodiment that corresponds to the "motor" according to the present invention.

The driving cylinder 121 is an example embodiment that corresponds to the "second cylinder" according to the present invention.

The driving piston 123 is an example embodiment that corresponds to the "second piston" according to the present invention.

The piston body 124 is an example embodiment that corresponds to the "sliding part" according to the present invention.

The driver 125 is an example embodiment that corresponds to the "driving part" according to the present invention.

The compression cylinder 131 is an example embodiment that corresponds to the "first cylinder" according to the present invention.

The compression piston 133 is an example embodiment that corresponds to the "first piston" according to the present invention.

The air passage 135 is an example embodiment that corresponds to the "compressed air supply passage" according to the present invention.

The valve 137 is an example embodiment that corresponds to the "valve member" according to the present invention.

EXPLANATION OF THE NUMERALS

100 nailer
101 body housing
101A driving mechanism housing part
101B compression device housing part
101C motor housing part
102 inner housing
103 handle
103*a* trigger
103*b* trigger switch
105 magazine
105*a* pusher plate
110 battery pack
111 electric motor
113 planetary gear type, speed reducing mechanism
115 crank mechanism
115*a* crank shaft
115*b* eccentric pin
115*c* connecting rod
120 nail driving mechanism
121 driving cylinder
121*a* cylinder chamber
121*b* cylinder head
135*e* annular groove
123 driving piston
124 piston body
125 driver
130 compression device
131 compression cylinder
131*a* compression chamber
131*b* cylinder head
133 compression piston
135 air passage
135*a* communication port
135*b* communication port
135*c* communication path
136 stopper
137 valve
137*a* engagement recess
138 compression coil spring
139*a*, 139*b* O-ring
141 driver guide
141*a* driving passage
142 biasing spring
143 contact arm switch
145 solenoid valve
145A valve body
145B electromagnet
181 cylindrical cam
181*a* cam face
185 link mechanism
185*a* first link
185*b* second link
186 support shaft
187 cam follower
189 pin
S hollow space

The invention claimed is:

1. A driving tool configured to drive an object by striking it, comprising:

a first cylinder having a longitudinal axis, a first piston slidably disposed within the first cylinder and configured to generate compressed air in the first cylinder, a motor configured to drive the first piston, a second cylinder having a longitudinal axis, a second piston slidably disposed within the second cylinder, the second piston having a first part configured to slide along a wall of the second cylinder and a second part connected thereto, the second part being elongated and configured to move linearly along an axis of movement to strike the object, a handle, and a magazine configured to feed the object onto the axis of movement of the second part, wherein:

the first cylinder is configured to supply compressed air into the second cylinder, the second piston is configured to linearly move toward a front end of the second cylinder by the compressed air and thereby cause the second part to strike the object, the longitudinal axis of the first cylinder intersects the second cylinder and extends alongside the magazine, the first piston is configured to slide in a direction of the longitudinal axis of the first cylinder alongside the magazine, the first cylinder is located between the handle and the magazine, and a rotation axis of the motor extends parallel to the longitudinal axis of the second cylinder.

2. The driving tool as defined in claim 1, wherein:

the magazine and the first cylinder are disposed at a front end region of the second cylinder, and the handle is disposed at a rear end region of the second cylinder on a side opposite to the front end region of the second cylinder.

3. The driving tool as defined in claim 1, wherein the magazine and the first cylinder are disposed adjacent to each other.

4. The driving tool as defined in claim 1, further comprising:

a compressed air supply passage configured to define a compressed air communication path between the first cylinder and the second cylinder, and a valve member disposed in a portion of the compressed air supply passage that connects to the second cylinder, the valve member being configured to selectively provide or cut off communication between the first cylinder and the second cylinder.

5. The driving tool as defined in claim 4, wherein the compressed air supply passage extends alongside the longitudinal axis of the second cylinder.

6. The driving tool as defined in claim 2, wherein a longitudinal axis of the magazine and the longitudinal axis of the first cylinder are disposed parallel to each other.

7. The driving tool as defined in claim 1, further comprising:

an operating member that is manually operable by a user in order to control the motor, wherein:

the first cylinder, the second cylinder, the handle and the motor are arranged to form a hollow space that is surrounded by the first cylinder, the second cylinder, the handle and the motor, and the operating member is arranged to project into the hollow space.

8. The driving tool as defined in claim 1, wherein the first cylinder, the second cylinder, the handle and the motor are arranged to respectively form four sides of a quadrilateral.

9. The driving tool as defined claim 1, wherein:

a first end of the handle is connected to the second cylinder, the handle extends in a crossing direction that crosses the longitudinal axis of the second cylinder, and the motor and a battery, which supplies power to the motor, are disposed at a second end side of the handle in the crossing direction.

10. The driving tool as defined in claim 2, wherein the magazine and the first cylinder are disposed adjacent to each other.

11. The driving tool as defined in claim 10, further comprising:

a compressed air supply passage configured to define a compressed air communication path between the first cylinder and the second cylinder, and a valve member disposed in a portion of the compressed air supply passage that connects to the second cylinder, the valve member being configured to selectively provide or cut off communication between the first cylinder and the second cylinder.

12. The driving tool as defined in claim 11, wherein the compressed air supply passage extends alongside the longitudinal axis of the second cylinder.

13. The driving tool as defined in claim 12, wherein a longitudinal axis of the magazine and the longitudinal axis of the first cylinder are disposed parallel to each other.

14. The driving tool as defined in claim 13, further comprising:

an operating member that is manually operable by a user in order to control the motor, wherein:

the first cylinder, the second cylinder, the handle and the motor are arranged to form a hollow space that is surrounded by the first cylinder, the second cylinder, the handle and the motor, and the operating member is arranged to project into the hollow space.

15. The driving tool as defined in claim 14, wherein the first cylinder, the second cylinder, the handle and the motor are arranged to respectively form four sides of a quadrilateral.

16. The driving tool as defined claim 15, wherein:

a first end of the handle is connected to the second cylinder, the handle extends in a crossing direction that crosses the longitudinal axis of the second cylinder, and the motor and a battery, which supplies power to the motor, are disposed at a second end of the handle in the crossing direction.

17. A pneumatic power tool configured to drive a fastener by striking it, comprising:

a first cylinder having a first longitudinal axis lying in a first plane, a first piston slidably disposed within the first cylinder and configured to generate compressed air in the first cylinder, a motor configured to reciprocally drive the first piston, a second cylinder having a second longitudinal axis that intersects the first plane, a second piston slidably disposed within the second cylinder and having a terminal portion configured to move linearly along an axis of movement to strike the fastener, a compressed air supply passage fluidly connecting the first cylinder to the second cylinder, a magazine configured to hold and feed the fastener onto the axis of movement of the terminal portion of the second piston, wherein the magazine has a third longitudinal axis that is parallel, or substantially parallel, to the first longitudinal axis, and a handle disposed such that the first cylinder is located between the handle and the magazine, wherein a rotation axis of the motor extends parallel to the second longitudinal axis.

18. The pneumatic power tool according to claim 17, wherein the first cylinder, the second cylinder, the handle and the motor are arranged to form a hollow space surrounded by the first cylinder, the second cylinder, the handle and the motor.

* * * * *